US006167810B1

(12) United States Patent
Isle et al.

(10) Patent No.: US 6,167,810 B1
(45) Date of Patent: Jan. 2, 2001

(54) PROPELLING MATERIAL FORMED IN STRIPS FOR USE IN LARGE CALIBER GUNS

(75) Inventors: Brian J. Isle, St. Francis; Gerald L. Dittmann, Woodbury; Amir Chaboki, Minneapolis; Steven R. Zelenak, Champlin; Timothy W. Petersen, Burnsville, all of MN (US)

(73) Assignee: United Defense, L.P., Arlington, VA (US)

( * ) Notice: Under 35 U.S.C. 154(b), the term of this patent shall be extended for 0 days.

(21) Appl. No.: 09/206,085

(22) Filed: Dec. 4, 1998

(51) Int. Cl.[7] ..... F42B 5/16

(52) U.S. Cl. ..... 102/443; 102/285; 102/288; 102/292

(58) Field of Search ..... 102/443, 288, 102/286, 283, 285, 292, 289, 430

(56) References Cited

U.S. PATENT DOCUMENTS

| | | | | |
|---|---|---|---|---|
| 846,612 | * | 3/1907 | Dupont | 102/430 |
| 1,920,075 | * | 7/1933 | Haenichen | 102/443 |
| 3,054,353 | * | 9/1962 | Rumpp et al. | 102/288 |
| 3,664,133 | * | 5/1972 | Iwanciow et al. | 60/255 |
| 4,408,534 | * | 10/1983 | Araki et al. | 102/288 |
| 4,615,270 | * | 10/1986 | Bell | 102/289 |
| 4,876,962 | * | 10/1989 | Olsson | 102/288 |
| 5,160,804 | * | 11/1992 | Wahner et al. | 102/443 |
| 5,180,883 | * | 1/1993 | Jaskolka et al. | 102/443 |
| 5,335,599 | * | 8/1994 | Thiesen et al. | 102/431 |
| 5,712,445 | * | 1/1998 | Kassuelke et al. | 102/288 |
| 5,892,172 | * | 4/1999 | Candland et al. | 102/288 |

* cited by examiner

*Primary Examiner*—Michael J. Carone
*Assistant Examiner*—James S. Bergin
(74) *Attorney, Agent, or Firm*—Ronald C. Kamp

(57) ABSTRACT

The invention provides an improved propellant system for firing projectiles in large caliber guns. Strips of energetic propellant are placed in the cartridge case so that the lengths of the strips are parallel to the length of the cartridge. Preferably, the strips are placed in a radially symmetric pattern. The strips provide passageways that allow ignition gasses to flow radially in the cartridge case and along the length of the cartridge case.

3 Claims, 4 Drawing Sheets

PROPELLING MATERIAL FORMED IN STRIPS FOR USE IN LARGE CALIBER GUNS

BACKGROUND OF THE INVENTION

The present invention relates generally to propellant charges in medium and large caliber cased or caseless gun systems. More specifically the invention is directed to the configuration of the charge that is loaded into the cartridge case assembly. The configuration, in this case, generally the shape, density and placement of the propellant charge is a departure from contemporary configurations.

Munitions that use solid propellants carried in the cartridge casing typically relied on spherical or cylindrical grain geometry for ease of processing. Burn rates, the speed that a flame front is propagated through the propellant, were controlled through geometry (i.e. grain perforations) or through chemical (i.e. deterrents) means. Burn rate modification and progressivity tuning are important considerations in designing charge loads. Another technique to provide a propellant in the cartridge is to use what are known as co-layered propellants in a disk or rolled scroll. Co-layered propellants being a descriptive term describing the use of layers of precut propellant elements cut from a sheet of propellant material. It is known to use co-layered propellants in the shape of rings or appertured disks of different propellants stacked in a sandwich configuration. In co-layered propellants so called "fast burn" propellant sheet stock, cut in the appropriate appertured disk or ring shape, is sandwiched between two layers of slower burning propellant sheet stock. The source of co-layered propellant sheets is Alliant Tech Systems who can provide the co-layered propellant in die-cut annular ring shapes or in uncut sheets.

Another use of co-layered propellants is in a rolled scroll form. In this configuration the propellant sheet is rolled to form a scroll. The scroll form is aligned longitudially with the boom of the projectile and if ignited from the end of the scroll, the normal technique, the flame propagation will be more difficult to control than the flame propagation of this invention. In the scroll form of propellant it is difficult to control bum propagation and there is a risk that waves of pressure may build to the point of weapon destruction. Therefore the scroll form of propellant is more difficult to specify than is the strip embodiment presented here.

One of the disadvantages of co-layered propellants is that the stacked disks provide, having only limited natural ullage, a barrier to gas flow which can lead to detrimental pressure waves in the gun. These detrimental waves are caused in part by the blockage presented by the disks. The invention presented in this specification avoids or minimizes the barrier to the gas flow as the strips of propellant allow sufficient ullage between the strips.

Another disadvantage of co-layered propellants in disk form, as is used in the prior designs, is that the manufacture of the rings creates a large amount of scrap propellant. It is known that to cut a circular disc from a rectangular sheet of propellant material will cause significant selvage or waste of material. The sheets of propellant are expensive and anytime you can save on material the cost of a loaded cartridge case will be commensurately lower.

SUMMARY OF THE INVENTION

One aspect of this invention is the use of strips of material which are placed in a shell casing in a direction that is aligned with the longitudial axis of the shell. The strips of material, the material being a propellant compound that is pressed and formed into sheets, are arranged to be vertical when the shell, for reference purpose, is stood on its end. One advantage of the strip contour, as contrasted to the disk shaped propellant, is that the strips are more economical to produce and produce less waste in the production cycle. In the scroll form of propellant packaging the sheets of propellant are well utilized. However, the burn characteristics of the scroll form are not as predictable as the disk embodiments or of the embodiments presented here.

In the development of this invention the inventors have found that the strip type of propellant will produce a better combustion event in a gun chamber. Therefore it is an object of this invention to provide a propellant charge in the form of a strip of propellant material such that a better, more complete and more uniform burn rate of the propellant is realized. The strips of propellant will bum more efficiently than known embodiments of either disk, scroll or solid rod type fuel charges.

It is another object of the invention to provide a propellant charge that is cut from a sheet of propellant material in an efficient way to minimize the amount of wasted propellant scrap.

It is also an advantage of this invention that the strips used will be self-supporting. The configuration and arrangement of the propellant strips will comprise a self-supporting column. This is beneficial as the column arrangement will not buckle or shift during transport or handling. Another advantage of the arrangement of the strips verses the disk arrangement is that with the embodiment incorporating the strips there will be a channel to accommodate the fins of the projectile.

One further advantage of the invention is that the position of the strips in a generally vertical column shape will allow the cartridge case to be slipped over the column of propellant material in the assembly phase. This is advantageous as the assembly of the cartridge and the propellant can be done cleanly and swiftly as there will be less potential interference between the edge of the shell and the column of propellant.

It is another object of the invention to provide a propellant charge which provides passageways and has an adequate percentage of ullage in the propellant charge to provide effective axial and radial flame propagation and flame spread paths.

One further advantage of the invention over the disks of the known art is that the strips can straddle the fins of the projectile boom whereas in the disk embodiment the disks are limited to being large in interior diameter to accommodate the fins extending radially outwardly from the boom of the projectile.

Another advantage of this invention is that the propellant strips can be contoured to follow the ramp angle of the boom allowing the use of more propellant in the cartridge or the same amount of propellant in a better distribution when compared to a conventional disk style embodiment.

One further advantage of the invention is that it lends itself well to the use in a modular charge. That is, the strips are easily contoured to a shape appropriate to a large number of possible uses, for instance in different gun systems.

Basically the invention setforth herein has as its object the improvement in the burn propagation of a flame in a large munition. This is to be accomplished while at the same time making the cost to produce the propellant charge less expensive through the elimination of waste in the production of usable propellant inserts.

These and other objects and advantages of the invention will be apparent to a person of skill in the munitions field as the following specification is comprehended and the accompanying drawing figures are studied.

The preferred embodiments of the invention presented here are described below in the drawing figures and Detailed Description of the Drawings. Unless specifically noted, it is intended that the words and phrases in the specification and the claims are given the ordinary and accustomed meaning to those of ordinary skill in the applicable arts. If any other special meaning is intended for any word or phrase, the specification will clearly state and define the special meaning.

Likewise, the use of the words "function" or "means" in the Detailed Description of the Drawings is not intended to indicate a desire to invoke the special provisions of 35 U.S.C. 112, Paragraph 6, to define the invention. To the contrary, if the provisions of 35 U.S.C. 112, Paragraph 6 are sought to be invoked to define the inventions, the claims will specifically state the phrases "means for" or "step for" and a function, without also reciting in such phrases any structure, material or act in support of the function. Even when the claims recite a "means for" or "step for" performing a function, if they also recite any structure, material or acts in support of that means or step, then the intention is not to invoke the provisions of 35 U.S.C. 112, Paragraph 6. Moreover, even if the provisions of 35 U.S.C. 112, Paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, material or acts for performing the claimed function.

BRIEF DESCRIPTION OF THE DRAWINGS

The invention will be understandable by a reading of the specification in combination with the drawing figures wherein.

DETAILED DESCRIPTION OF THE DRAWINGS

Figure 1:
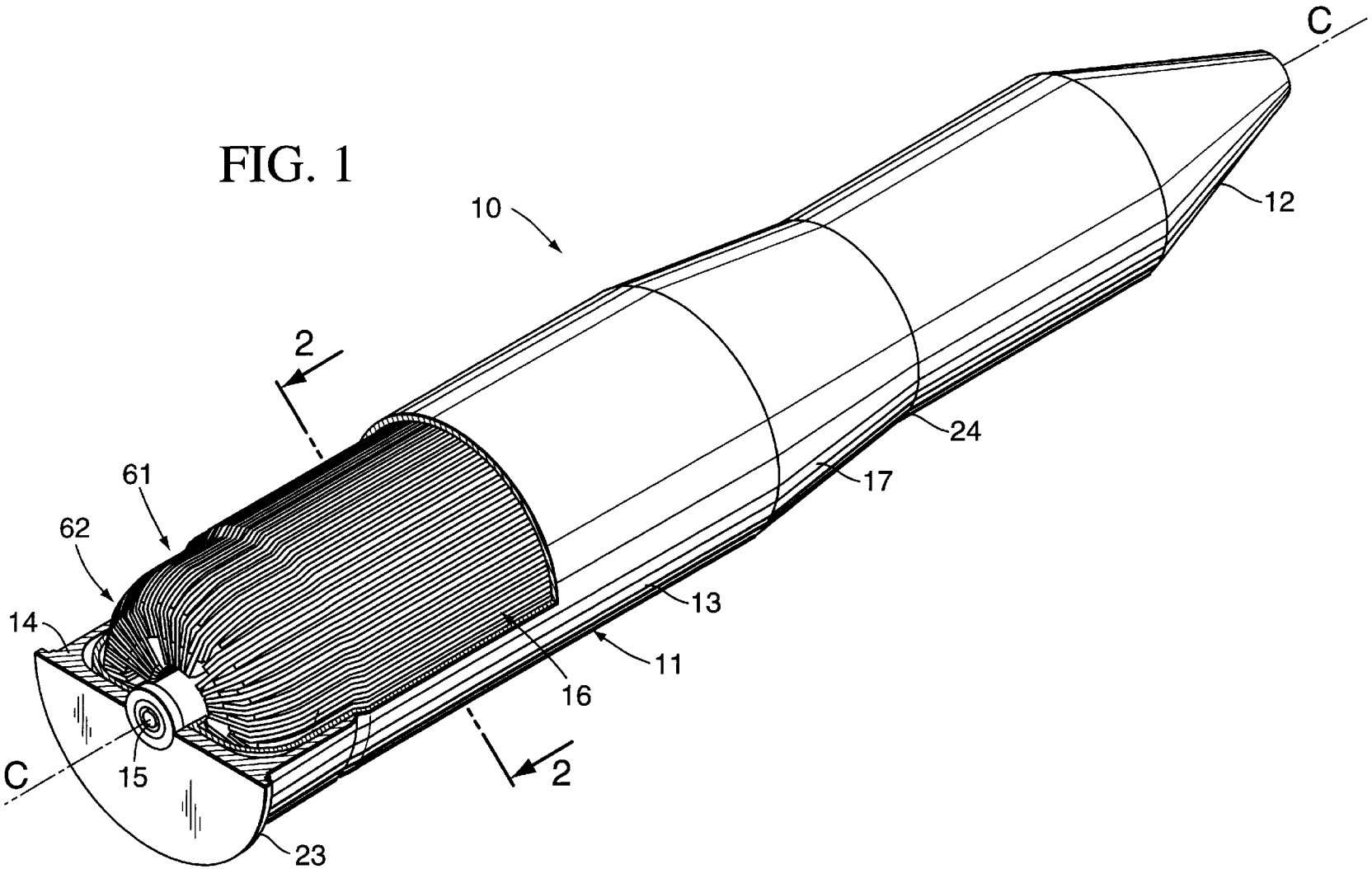
FIG. 1 is a perspective view of a large caliber gun cartridge with a portion broken away to reveal the interior of the cartridge.

A large caliber gun cartridge 10, FIG. 1, comprises a cartridge case assembly 11 and a projectile 12. (In this specification, and in some claims, the term "shell casing" is sometimes used rather than the term "cartridge." These terms are intended to be descriptive and describe the container in which a charge portion of a munition is contained. No unusual or limiting definition is intended by this word choice.) A portion of the cartridge case 11 has been broken away to reveal the contents of the cartridge case. The cartridge case assembly 11 comprises a cartridge wall 13, a stub case 14, an igniter 15, and a propellant charge 16. The cartridge may include a chambrage region 17. In this preferred embodiment, the propellant charge 16, comprises four sets of propellant strips. Each set of propellant strips has a different contour which are most discernable when comparing the widths of each set of propellant strips. It is contemplated to use more or less than four sets of propellant strips but for this preferred embodiment four sets will be described.

The stub case 14 is located at a first end 23 of the cartridge case assembly 11. The projectile 12 of the round is located outboard of the chambrage 17 of the cartridge case assembly 11.

The cartridge 10 has a central axis C—C running the length of the cartridge 10.

Figure 2:
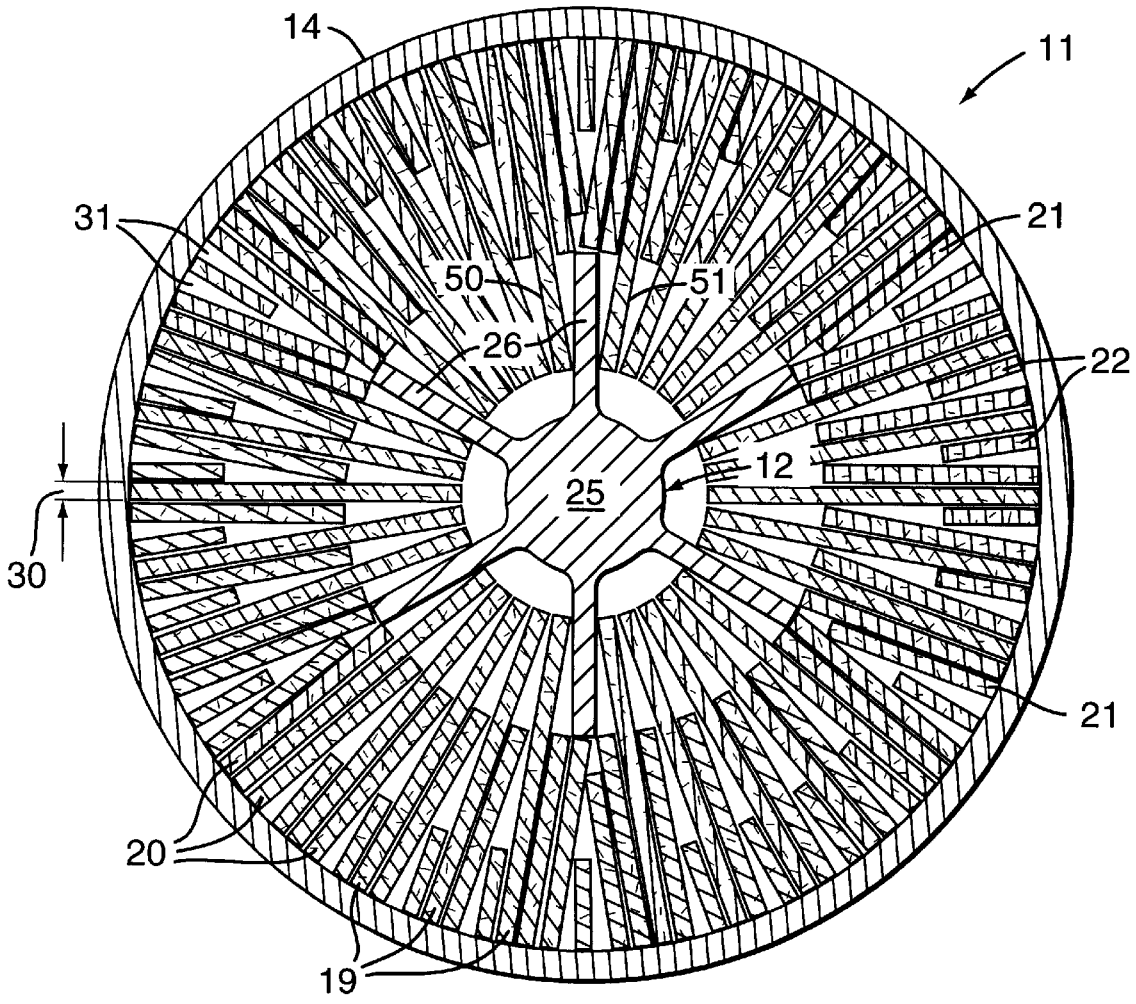
FIG. 2 is a cross-sectional view through 2—2 (without regard to the broken away portion of FIG. 1) of a large caliber gun cartridge illustrated in FIG. 1.
Figure 3A:
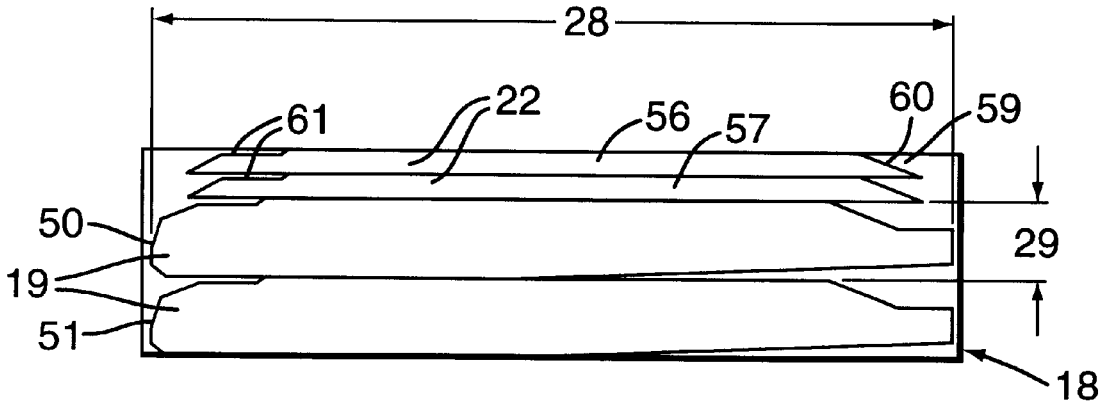
FIGS. 3*a*, 3*b* and 3*c* are plan views of sheets of propellant with the outline of the shape of strips that will be cut from the sheets drawn on the sheets.
Figure 3B:
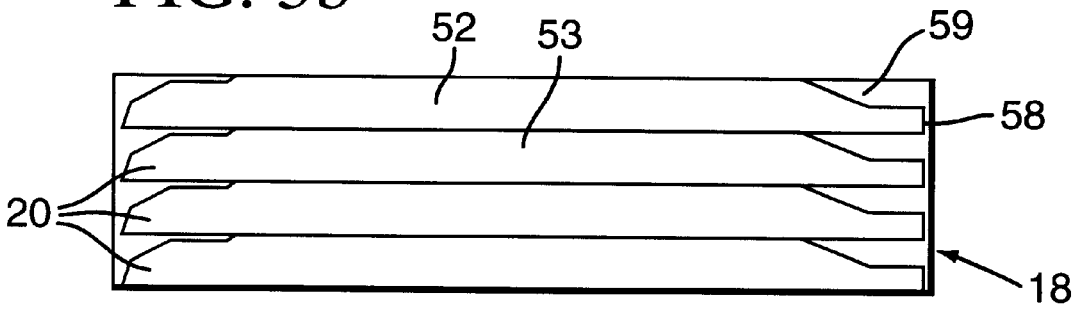
Figure 3C:
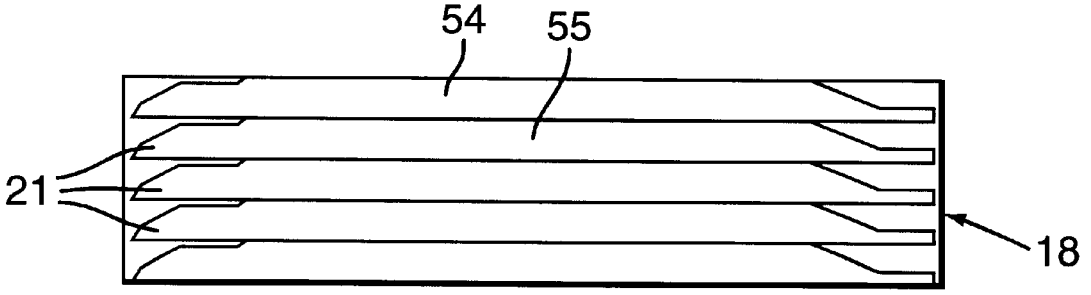

FIG. 2 is a cross-sectional view through plane 2—2 without regard to the broken away portion of the cartridge case assembly 11 of the cartridge illustrated in FIG. 1. A specific arrangement of propellant strips are set forth in this view. Other arrangements and configurations are also possible. FIGS. 3*a*, 3*b*, and 3*c* illustrate an assortment of sheets of propellants 18. Strips of propellant material are cut out of these sheets of processed propellant.

The strips of the first set of radial strips 19 each have a length, the length of the strip being identified as 28 and the width of the strip being identified as 29. The thickness, identified as 30, of a strip of the first set of radial strips 19 is shown in FIG. 2. The length 28 of a strip is greater than the width 29 of a strip. The thickness of all the strips in this embodiment is less than the length or the width of the strips. The thickness of the strips will be on the order of between 0.100 inches and 0.200 inches. Strip thicknesses which are thicker or thinner, or otherwise outside the stated range, are also possible. The necessities of the design will dictate the actual optimum width however it is believed that a width in this range will be acceptable to the functionality of the design.

The strips, such as strips 50 and 51, of the first set of strips 19 are the widest strips. These strips are generally as shown in FIG. 3a with a multi-angle blunt nose and an extended tail portion as shown to the right side of the drawing. The length and width of the strips would be dependent on the cartridge into which the strips are to be packaged or loaded.

The strips, such as 52 and 53, of the second set of strips 20 are the second widest strips. They are just slightly more narrow than the width of the first set of wide strips. These strips, 52 and 53 for instance, have generally parallel edges and a semi-blunt nose portion. The tail portion, such as 58, has a cutback zone, that being the upper contour in FIG. 3*b*. The cutback portion 59 is the same contour shape as the tail contour shape of the first, second and third strip sets. The tail portion of all except the fourth set of strips is actually the leading or upper end of the packed cartridge when the cartridge is stood on its first end.

The strips, such as 54 and 55 as shows in FIG. 3*c*, of the third set of radial strips 21 are the third widest strips. These strips have a nose portion that is less blunt then the wider strips. The tail contour on the cutback zone is the same as the cutback zone tail contours of the wider strips.

The strips, such as 56 and 57, of the fourth set of radial strips 22 are the narrowest strips. These strips have what appears to be a totally different contour but there are similarities to the other sets of strips. These similarities include the ramp portion 60 of the cutback contour 59. They also include a relief cutout 61 at the nose of the strip. This relief cutout 61 is also formed in each of the other three strip contours as can be seen in FIG. 3*a*.

The position of the relief cutout, such as 61, can be seen generally as the zone 61 in FIG. 1. The blunt nose portions of the strips can be generally seen in the zone 62 of FIG. 1.

The strips discussed above would normally have a flat surface on each side of the strip. This would be one surface option when the strips are calendared in the production process. Alternatively, the strips can be embossed or provided with a textured or patterned surface that can enhance the ignition characteristics, flame propagation, or structural characteristics of the strips. In the disk embodiment of propellant sheets the disks are often pressed or calendared to have an embossed surface. Similar techniques can be used in the production of propellant sheets destined to be cut into strips as discussed above.

In the cross section shown in FIG. 2, the boom or boatel 25 of the projectile is placed along a central axis C—C of the cartridge case assembly 11. Fins 26 extend radially from the boom 25. The length of the cartridge extends along the central axis C—C of the cartridge 11 from the first end to the second end. In this FIG. 2 the relationship between the fins 26 and the surrounding strips can be seen. The fins 26 are interstitially positioned between adjacent widest strips such as 50 and 51. Outboard of the ends of the fins are positioned a selection of strips which are not as wide as the strips adjacent the fins in FIG. 2.

In the manufacture of an a large caliber gun cartridge 10 using the preferred embodiment described above, the cartridge 11, without the stub case 14, is placed on the end of the projectile 12 around the boom 25 and fins 26. In a typical production environment fifteen sheets of propellant 18 will be used to provide thirty strips of the first set of strips 19. These are the widest strips of the assembly. Thirteen sheets of propellant 18 are needed to supply the forty-two strips of the second set of strips 20. Six strips can be cut from a little more than one standard sheet of propellant to provide what is needed the third set of radial strips 21. Obviously these numbers relate only to one given production embodiment and would be different with other size sheets and other strip contours.

As stated above the strips of the sets of first, second, third, and fourth strips are tapered, as shown in FIGS. 3*a*, 3*b*, and 3*c* to allow the strips to conform to the geometry of the host cartridge. Because the sheets of propellant 18 all have the same thickness in this embodiment, the strips of the sets of first, second, third, and fourth strips end up being the same thickness. There is no reason why various strips can't be cut from different thicknesses of base stock of propelling sheets. Embodiments of this invention having a combination of different thickness strips is contemplated.

The configuration of the strips, as contrasted to the punched out annular or disk shapes, cut from the sheets of propellant 18 allows the minimization of wasted square inches of propellant.

Returning to the assembly of the package, it should be noted that the cartridge is assembled from the first end 23. The cartridge case 11 is open at the first end 23 during loading. After loading the strips of propelling material the stub case 14 is fitted to the end of the cartridge case. The second end 24 of the cartridge case contains the projectile to which may be attached the extended boom and fin section. Envision this assembly being upright in a holding fixture waiting for the propellant strips to be placed around the boom and fin section.

The radial strips will be arranged around the boom and fins with the tail portions 58 of the strips projecting into the second end of the cartridge case. The strips can be closely contoured to fit adjacent the boom. This is in contrast to the disk embodiments of the contemporary embodiments which have to have fin clearance and therefore can't be contoured close to the boom.

The strips of the sets of first, second, third, and fourth strips are placed in the cartridge 11 around the boom 25. The length of each strip of the sets of first, second, third, and fourth strips is substantially parallel to the central axis C—C. The width of each strip of the sets of first, second, third, and fourth strips is substantially perpendicular to the central axis C—C and radial central axis, as show in FIGS. 1 and 2. Gaps between the strips creates passageways 31. These gaps and voids are sometimes called "ullage." The passageways 31 extend radially from near the boom 25 of the projectile 12 to near the cartridge wall 13. The passageways 31 also extend axially along the length of the cartridge 11. This ullage is beneficial in the flame propagation and the promotion of the controlled burn and combustion of the propellant strips.

The stub case 14 is placed in the end of the cartridge 11 after the cartridge 13 has been slid over the propellant strips that have been arranged around the boom and fins. Sliding the cartridge case over the propellant strips is a smooth operation as it is easier to keep the strip elements aligned properly. In disk embodiments the disks present what equates to a series of steps that have to be carefully navigated as the cartridge is placed in position. The stub case 14 covers the strips of the sets of first, second, third, and fourth strips. An igniter device 15 is installed in the stub case 14. The igniter 15 resides inboard of the nose ends of the collection of strips, that is between the nose portions of strips of the sets of first, second, third, and fourth strips.

In operation, the cartridge 10 is placed in a gun system. A signal to the igniter 15 causes the igniter 15 to ignite the propellant charge 16 adjacent to the igniter 15. The passageways 31 allow the ignition of the propellant to quickly travel radially from the igniter 15 to the cartridge wall 13, and to quickly travel axially from the first end 23 of the cartridge case assembly 11 adjacent to the igniter 15 to the second end 24 of the cartridge case assembly 11 adjacent to the projectile 12. The passageways 31 also allow the first ignited propellant adjacent to the igniter 15 to expand and pass with little or no hindrance through the passageways 31 to the projectile 12. This will provide pressure on the projectile while minimizing detrimental axial pressure waves. The ignited propellant puts a force on the projectile 12, causing the projectile to accelerate and be shot out of the gun barrel. The cartridge case assembly 11 is removed from the gun and replaced by an unfired, fresh cartridge.

Figure 4:
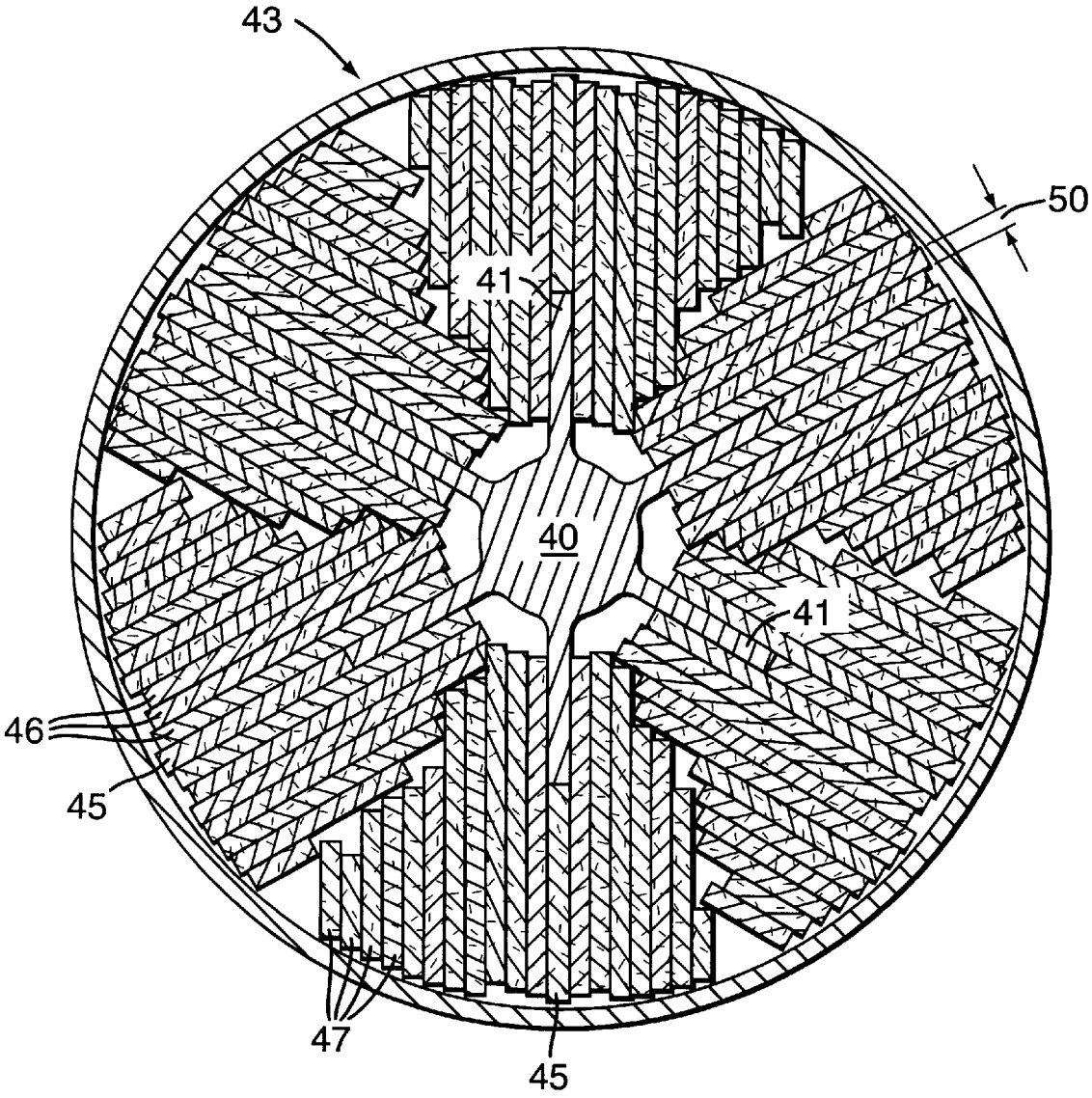
FIG. 4 is a cross-sectional view of another embodiment of the invention.

FIG. 4 is a cross-sectional view of another embodiment of the invention. A boom 40 of a projectile with fins 41 is placed along a central axis of a cartridge 43. A first set of strips 45 are placed so that the widths of the first set of strips 45 extend from the wall of the cartridge 43 to the fins 41 of the tail 40 as shown. A second set of strips 46 are placed so the widths of the second set of strips extend from the cartridge 43 to the tail 40 adjacent to the fins 41. A third set of strips 47 of various widths are placed so that the widths of the third set of strips 47 fill-in a portion of the remaining gaps as shown. Some ullage remains and this is beneficial for flame propagation. The strips of the second set of strips 46 have the widest widths. All of the first, second, and third sets of strips 45, 46, and 47 are shown having the same thickness 50 in this embodiment. The lengths of the strips of the first, second and third set of strips is not apparent from this view but they will project generally from a stub case to the second end of the cartridge case as in the first embodiment. As in the previous embodiment, passageways are formed between strips that pass from the cartridge wall to the boom, and from the back end of the cartridge to the front end of the cartridge.

In its most basic embodiment the invention comprises a first strip of propellant material having a length and a width. The length of the propellant material is greater than the width of the propellant material and the first strip comprising a flat plane when viewed in a planar view. Of course in most instances it will be necessary to use a plurality of strips together and in that usual case at least one additional strip of propellant material each comprising a flat plane will be combined with the first strip of propellant material to form a set of strips of propellant materials. It has been found that flat strips are very effective in most embodiments however the strips of propellant material can have embossed surfaces. In another embodiment the strips will be of a non-rectangular shape. This being the usual rather than the exceptional situation. In this embodiment the first strip of propellant material has a first edge, as viewed in a planer view, defining the length of the first strip and a second edge non-parallel to the first edge. At least one of these edges, the planer view not a "side on" or elevation view, will define different radii relative to each other.

While preferred embodiments of the present invention have been shown and described herein, it will be appreciated that various changes and modifications may be made without departing from the spirit of the invention as defined by the scope of the appended claims. For instance, it is certainly possible to change the contour of the strips, they could even be as simple as rectangular strips with no curves at all. The idea is that the contour is determined by the interior space available in a cartridge and the amount of ullage needed for good burn propagation. Another example is an embodiment wherein the strip propellant is packaged in preconfigured, unified, "ready to use" packages for use in large caliber guns.

What is claimed is:

1. A propellant system having a cartridge case and a projectile associated with the cartridge case, said projectile having fins projecting substantially radially from the center of the cartridge case toward the periphery thereof, comprising:

a plurality of strips made of energetic propellant material;

each of said plurality of strips having a width and a substantially uniform thickness;

all of said plurality of strips being arranged around the periphery of the cartridge case with the widths thereof being directed inward;

said strips arranged in a plurality of groups with each group associated with one of the fins; and the strips in each group being parallel to the associated fin, whereby the intersections between adjacent groups of strips creates spaces to provide for flame propagation and for uniform gas pressure increase as a result of the burning of said strips.

2. The propellant system according to claim 1 wherein said fins have a fin thickness and said uniform thickness is substantially equal to said fin thickness.

3. The propulsion system according to claim 2 wherein;

one strip in each group of strips has a width substantially equal to the distance between said periphery and the associated fin; and said one strip is positioned between the case and said associated fin and in alignment therewith.

* * * * *